US008485851B2

(12) United States Patent
Kondo et al.

(10) Patent No.: US 8,485,851 B2
(45) Date of Patent: Jul. 16, 2013

(54) CONNECTOR

(75) Inventors: Hayato Kondo, Yao (JP); Yutaka Masumoto, Yao (JP); Toshiharu Miyoshi, Yao (JP)

(73) Assignee: Hosiden Corporation, Yao-shi (JP)

( * ) Notice: Subject to any disclaimer, the term of this patent is extended or adjusted under 35 U.S.C. 154(b) by 483 days.

(21) Appl. No.: 12/714,851

(22) Filed: Mar. 1, 2010

(65) Prior Publication Data

US 2010/0248515 A1 Sep. 30, 2010

(30) Foreign Application Priority Data

Mar. 24, 2009 (JP) ..... 2009-071703

(51) Int. Cl.
*H01R 24/00* (2006.01)

(52) U.S. Cl.
USPC ..... 439/660; 439/79; 439/83

(58) Field of Classification Search
USPC ..... 439/660, 79, 607.35–607.37, 83
See application file for complete search history.

(56) References Cited

U.S. PATENT DOCUMENTS

| | | | | |
|---|---|---|---|---|
| 6,974,336 | B2 * | 12/2005 | Shindo | 439/79 |
| 7,402,084 | B2 * | 7/2008 | Wu | 439/660 |
| 7,699,663 | B1 * | 4/2010 | Little et al. | 439/660 |
| 2007/0066115 | A1 * | 3/2007 | Saito et al. | 439/260 |
| 2009/0068886 | A1 | 3/2009 | Ju | 439/607 |
| 2009/0227147 | A1 * | 9/2009 | Momose | 439/638 |

FOREIGN PATENT DOCUMENTS

| | | | |
|---|---|---|---|
| JP | 2005-5272 | A1 | 1/2005 |
| JP | 2005-530309 | A | 10/2005 |
| JP | 2007-214139 | A | 8/2007 |
| JP | 2007-220591 | A | 8/2007 |
| JP | 3148109 | U | 1/2009 |
| WO | WO 03/026078 | A1 | 3/2003 |
| WO | WO 03/084000 | A1 | 10/2003 |
| WO | WO 2004/001907 | A1 | 12/2003 |

OTHER PUBLICATIONS

European Search Report dated Aug. 3, 2010 for the counterpart European patent application No. 10250543.5.
Notification of Reasons for Refusal dated Apr. 19, 2011 for the counterpart Japanese application No. 2009-071703 with English translation.

* cited by examiner

*Primary Examiner* — Hien Vu
(74) *Attorney, Agent, or Firm* — Kratz, Quintos & Hanson, LLP

(57) ABSTRACT

A connector has a first contact and first signal contacts, and a second contact and second signal contacts arrayed at a different height. All the contacts have connection portions arranged at the same height position. The connection portion of the first contact is located between the connection portions of the second signal contacts and the connection portion of the second contact is located between the connection portions of the first signal contacts. A distance B is larger than a distance A. The distance A is a distance between the connection portion of the first signal contact and the connection portion of the second contact and also a distance between the connection portion of the second signal contact and the connection portion of the first contact. The distance B is a distance between the connecting portion of the first signal contact and an adjacent connection portion of the second signal contact.

13 Claims, 7 Drawing Sheets

CONNECTOR

The present application claims priority under 35 U.S.C. §119 of Japanese Patent Application No. 2009-071703 filed on Mar. 24, 2009, the disclosure of which is expressly incorporated by reference herein in its entity.

BACKGROUND OF THE INVENTION

1. Technical Field

The present invention relates to connectors mainly used for high-speed digital transmission.

2. Background Art

A conventional connector of this type has upper and lower contact groups arrayed inside a body thereof. The lower contact group includes a pair of contacts for differential signaling, and other contacts. The upper contact group includes a ground contact relating to the pair of contacts, which is located so as to face a space between the pair of contacts, and other contacts (see paragraphs 0032 and 0033, and FIGS. 2 and 5 of Patent Literature 1).

All the contacts of the lower contact group have rear end portions projected from the body and bent generally into L shapes. The horizontal portions of the rear end portions serve as connection portions to be mounted on wiring lines on a circuit board. All the contacts of the upper contact group also have rear end portions projected from the body and bent generally into L shapes. The horizontal portions of the rear end portions are arranged at the same height as the connection portions of the lower contact group and serve as connection portions to be mounted on wiring lines on a circuit board. (See FIG. 7 of Patent Literature 1).

Citation List

Patent Literature

Patent Literature 1: Japanese Unexamined Patent Publication No. 2005-5272

SUMMARY OF INVENTION

Technical Problem

In the above-described conventional connector, the connection portions of the contacts of the upper and lower contact groups are lined up at the same height. The connection portions are arranged at substantially equal distances from each other. This arrangement may potentially cause crosstalks between the connection portions of the pair of contacts for differential signaling and the connection portion of the adjacent contact.

The present invention is devised in light of the above-described situation. An object of the invention is to provide a connector that is less likely to cause crosstalks between adjacent connection portions of signal contacts.

Solution to Problem

In order to solve the above-described problem, a connector of the present invention includes a body with insulation properties; a first contact group arrayed inside the body and including a first contact and a pair of first signal contacts; and a second contact group arrayed inside the body, substantially in parallel with and at a different height position from the first contact group, the second contact group including a second contact and a pair of second signal contacts. The first contact of the first contact group is located so as to face a space between the second signal contacts of the second contact group. The second contact of the second contact group is located so as to face a space between the first signal contacts of the first contact group. The first signal contacts each have a connection portion extending outside the body. The second signal contacts each have a connection portion extending outside the body and at a same height position as the connection portions of the first signal contacts. The first contact has a connection portion extending outside the body, the connection portion being located between and at the same height position as the connection portions of the second signal contacts. The second contact has a connection portion extending outside the body, the connection portion being located between and at the same height position as the connection portions of the first signal contacts. A distance B is larger than a distance A, wherein the distance A is a distance between the connection portion of each of the first signal contacts and the connection portion of the second contact and also a distance between the connection portion of each of the second signal contacts and the connection portion of the first contact, and the distance B is a distance between one of the connection portions of the first signal contacts and an adjacent one of the connection portions of the second signal contacts.

In the above-described connector, the distance B between one of the connection portions of the first signal contacts and an adjacent one of the connection portions of the second signal contacts is larger than the distance A between the connection portion of each first signal contact and the connection portion of the second contact and than the distance A between the connection portion of each second signal contacts and the connection portion of the first contact. In this arrangement of the connection portions, even though the connection portions of all the contacts are arrayed at the same height, crosstalks are less likely to occur between one of the connection portions of the first signal contacts and an adjacent one of the connection portions of the second signal contacts.

Moreover, the connection portions of the first and second contacts are located between the connection portions of the second signal contacts and of the first signal contacts, respectively. Such location is advantageous in minimizing the lengths of ground or other lines on the signal plane of the circuit board for connection with the connection portions of the first and second contacts. More particularly, the ground or other lines can be made shorter by connecting them to a plane (e.g., a ground plane) that is different from the signal plane of the circuit board when the connection portions are connected onto the circuit board. It is thus possible to form almost straight signal lines on the signal plane of the circuit board for connection with the first and second signal contacts, facilitating the connection of the first and second signal contacts to the signal lines of the circuit board. Moreover, the almost straight signal lines of the circuit board, having no bent portions, can deter reflection of signals causing deterioration in transmission characteristics.

The first and second signal contacts may be contacts for differential signaling.

The first contact group may further include an additional pair of the first signal contacts, The second contact group may further include an additional second contact.

If the first contact group is a USB 3.0 compliant contact group, and the second contact group is a USB 2.0 compliant contact group, one of the second contacts may be a ground contact, and the other second contact may be a power source contact. In this case, each of the second contacts of the USB 2.0 contact group is located so as to face the space between the first signal contacts of the USB 3.0 contact group. Although the second contacts are not reference grounds of the first signal contacts, they serve as ground contacts for the first signal contacts in terms of high frequency. The second contacts can be thus used for impedance matching between the first signal contacts, improving transmission characteristics of the first signal contacts. Similarly, the first contact of the USB 3.0 contact group is located so as to face the space between the second signal contacts of the USB 2.0 contact group. Although the first contact is not a reference ground of the second signal contacts, either, it serves as a ground contact for the second signal contacts in terms of high frequency. The first contact thus can be used for impedance matching between the second signal contacts, improving transmission characteristics of the second signal contacts. In this manner, impedances can be matched between the second signal contacts using the first contact of the USB 3.0 contact group, and between the first signal contacts using the second contacts of the USB 2.0 contact group. Consequently, the connector has a simple configuration, compared to a case of adding contacts for impedance matching between the differential pair contacts. In this respect, the connector of the invention is advantageous in downsizing and cost reduction.

Alternatively, the connector of the invention may be configured such that the first contact group is arranged in compliance with a first standard, and that the second contact group is arranged in compliance with a second standard that is different from the first standard. In this case, the second contact of the second contact group is each located so as to face the space between the first signal contacts of the first contact group in compliance with a different standard. Although the second contact is not a reference ground of the first signal contacts but can serve as a ground contact for the first signal contacts in terms of high frequency. The second contact can be thus used for impedance matching between the first signal contacts, improving transmission characteristics of the first signal contacts. Similarly, the first contact of the contact group is located so as to face the space between the second signal contacts of the second contact group in compliance with the different standard. Although the first contact is not a reference ground of the second signal contacts, either, it can serves as a ground contact for the second signal contacts in terms of high frequency. The first contact thus can be used for impedance matching between the second signal contacts, improving transmission characteristics of the second signal contacts. In this manner, impedances can be matched between the second signal contacts using the first contact of the first contact group, and between the first signal contacts using the second contact of the second contact group. Consequently, the connector has a simple configuration, compared to a case of adding contacts for impedance matching between the differential pair contacts. The connector is thus advantageous in downsizing and cost reduction.

Each of the first signal contacts may further have a contact portion contactable with a contact of a counterpart connector and a body portion continuing to the contact portion. The distance between the body portions of the first signal contacts may be adjusted in accordance with an impedance difference between the first signal contacts. Specifically, it is preferable that the distance between the body portions of the first signal contacts is adjusted to be substantially the same as the distance between the connection portion of each of the first signal contacts and the connection portion of the second contact.

In this aspect of the invention, the adjustment of the distance between the body portions of the first signal contacts can prevent possible impedance mismatch between the first signal contacts due to the arrangement that the connection portion of the second contact is located between and at the same height as the connection portions of the first signal contacts so that the distance between the connection portions of the first signal contacts and the connection portion of the second contact is smaller than the distance between the body portions of the first signal contacts. Such matched impedance between the first signal contacts can be realized in a simple configuration because the distance between the body portions of the first differential signal contacts is just adjusted as described above.

More particularly, the distance between the body portions of the first signal contacts may be adjusted by extending the body portions in width of the first signal contacts or by bending the body portions of the first signal contacts in a direction closer to each other. In the former solution, the first signal contacts are not bent at all or bent to a reduced degree in a direction closer to each other (i.e. inward). It is thus expected that the first signal contacts are improved in transmission characteristics.

The body can be configured to have a first block, in which the first contact group is arrayed, and a second block, in which the second contact group is arrayed. In this case, when the first block is attached to the second block, the first contact is placed so as to face the space between the pair of second signal contacts, and the second contact is placed so as to face the space between the pair of the first signal contacts.

In this case, simply by attaching the first block to the second block, the first contact can be located so as to face the space between the pair of second signal contacts, and the second contact can be located so as to face the space between the pair of first signal contacts. Consequently, it is extremely easy to array the first and second contact group in the body.

The second block may have a base portion, in which the second contact group is arrayed, and a pair of guide members provided on the base portion to hold opposite end portions of the first block in a slidable manner. In this case, the first block can be attached to the second block only by inserting the first block between the guide members of the second block.

BRIEF DESCRIPTION OF DRAWINGS

FIG. 3A is a front view, FIG. 3B is a rear view, FIG. 3C is a plan view, FIG. 3D is a bottom view, and FIG. 3E is a side view.

DESCRIPTION OF EMBODIMENTS

Figure 1:
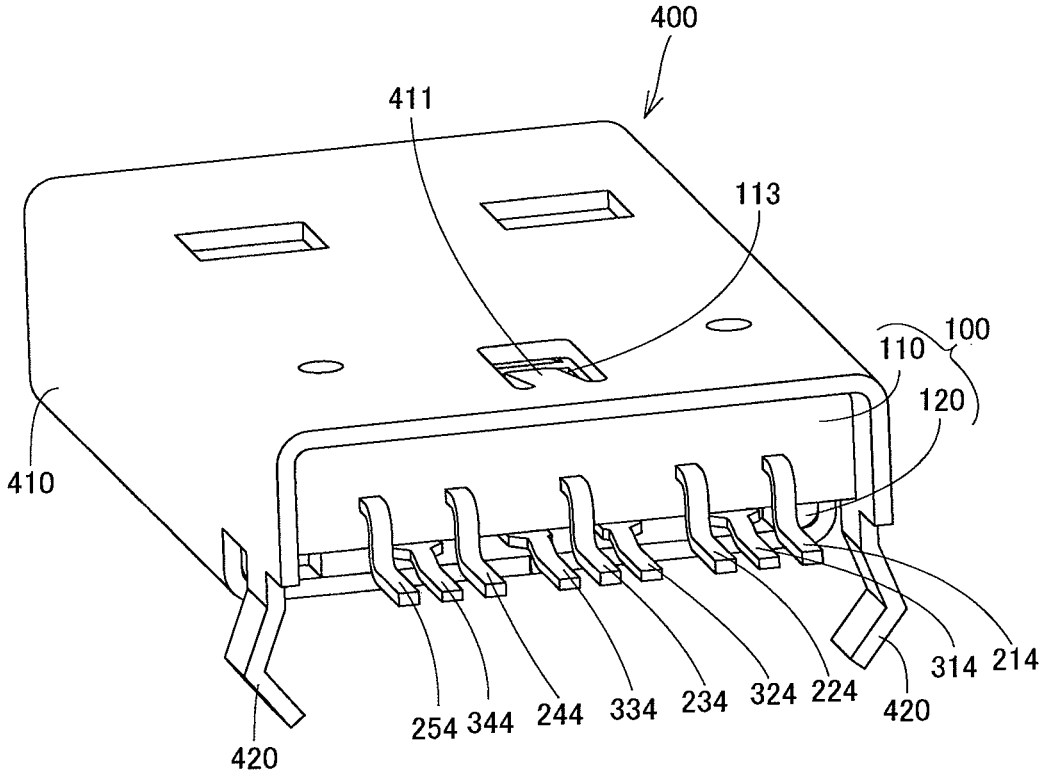
FIG. 1 is a schematic perspective view of a connector according to an embodiment of the present invention.

A connector according to an embodiment of the present invention will be hereinafter described referring to FIGS. 1 to 7.

A connector shown in FIGS. 1 to 3E is a receptacle connector to be mounted on a circuit board 10 and connectable with a plug compliant with USB 3.0 or USB 2.0 standard (not shown). The connector has a body 100, a USB 3.0 contact group 200 (first contact group), a USB 2.0 contact group 300

(second contact group), and a shell 400. Each of these components will be hereinafter described in detail.

Figure 2:
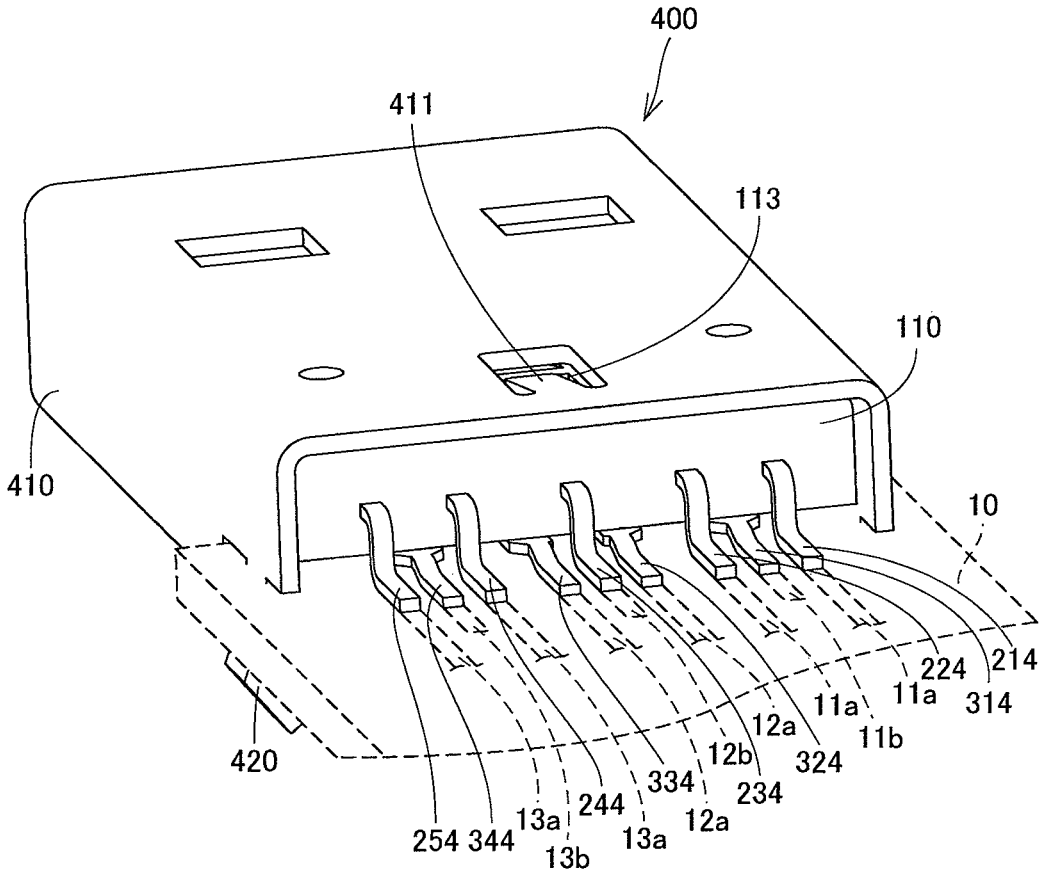
FIG. 2 is a schematic perspective view showing a state where the connector is mounted on a circuit board.

The circuit board 10 is a well-known multilayer printed circuit board. In the circuit board 10, the surface of the top layer (i.e., the upper surface of the circuit board) serves as a signal plane, while the surface of the bottom layer (i.e., the lower surface) of the circuit board 10 serves as a ground plane. On the upper surface of the circuit board 10, pairs of signal lines 11*a*, 12*a*, 13*a*, a power source line 11*b* and ground lines 12*b*, 13*b* are arranged as shown in FIG. 2. More particularly, the power source line lib is disposed between the signal lines 11*a* and is connected to an intermediate layer of the circuit board 10. The ground line 12*b* is disposed between the signal lines 12*a* and is connected to the ground plane of the circuit board 10. The ground line 13*b* is disposed between the signal line 13*a* and is connected to the ground plane of the circuit board 10.

The USB 3.0 contact group 200 as shown in FIGS. 1 to 4 includes a TX+ signal contact 210 (one of a pair of first differential signal contacts), a TX− signal contact 220 (the other of the pair of first differential signal contacts), a ground contact 230 (a first contact), a RX+ signal contact 240 (one of a pair of first differential signal contacts), and a RX− signal contact 250 (the other of the pair of first differential signal contacts).

Figure 4:
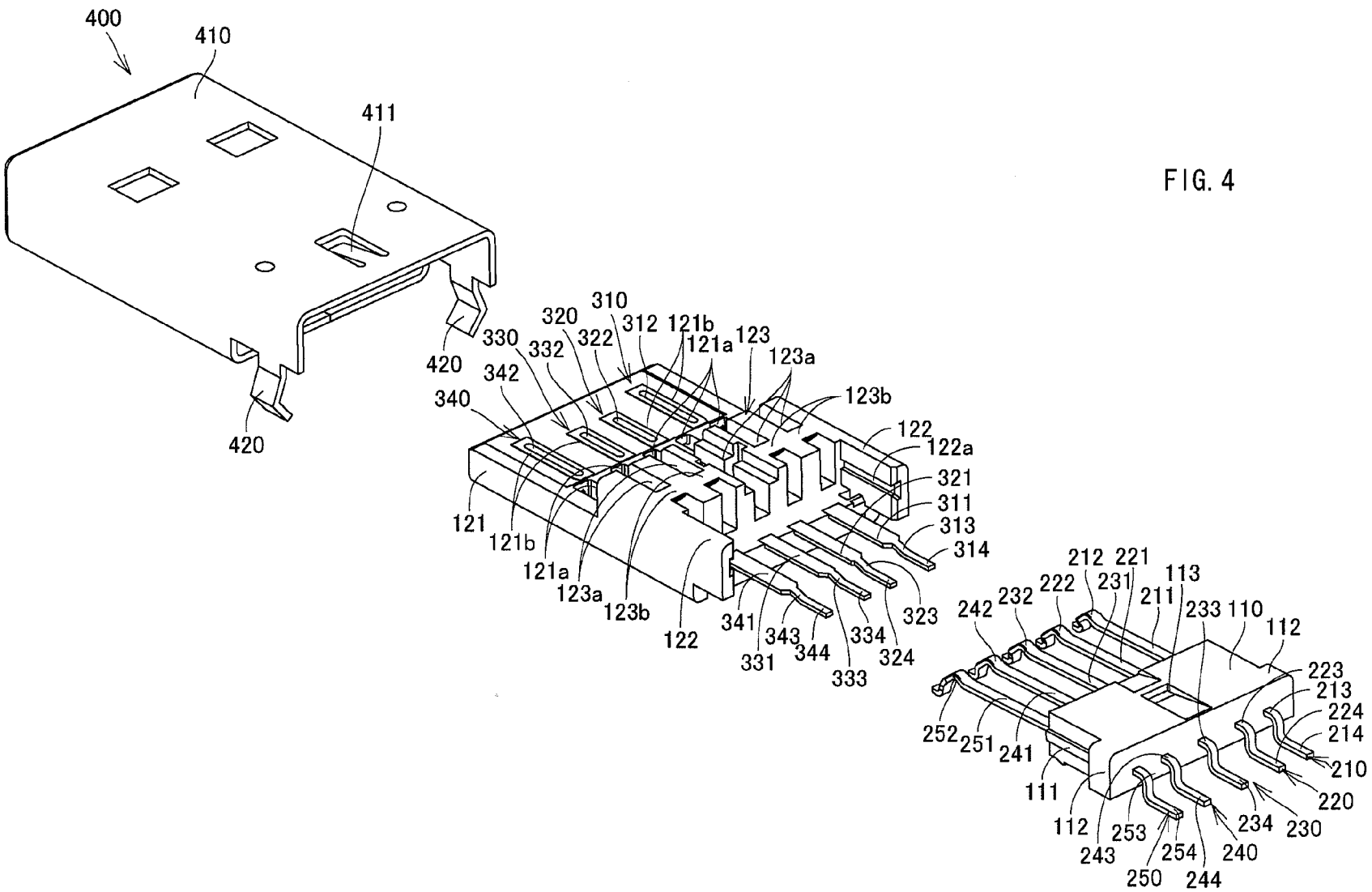
FIG. 4 is a schematic exploded perspective view of the connector.

As shown in FIG. 4, the TX+ signal contact 210 has a plate-like body portion 211, a contact portion 212 in a substantially reverse V-shape in section view continuing to a front end of the body portion 211, a bent portion 213 in a substantial reverse L shape in section view continuing to a rear end of the body portion 211, and a cuboid connection portion 214 continuing to a rear end of the bent portion 213.

Figure 3:
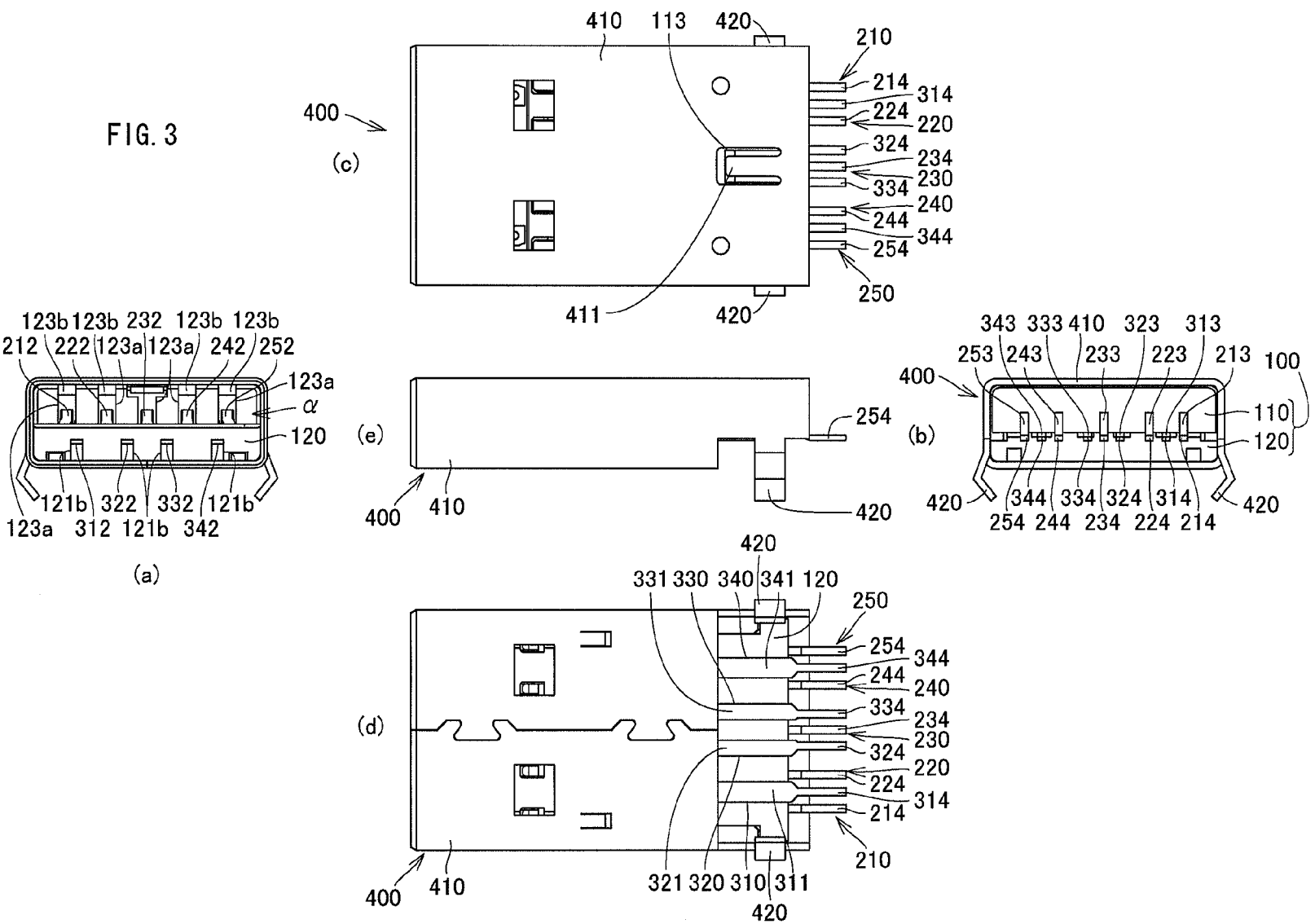
FIGS. 3A to 3E are schematic views of the connector, where

The contact portion 212 is adapted to contact a USB 3.0 plug contact of a USB 3.0 compliant plug. The rear end portion of the body portion 211 is buried by insert molding in a first block 110 (to be described) of the body 100. When the first block 110 is attached to a second block 120 (to be described) of the body 10 as shown in FIG. 3, the front end portion of the body portion 211 is inserted into a guide groove 123*a* of the second block 120. The front end portion of the body portion 211 is elastically deformed downward when contacted by a USB 3.0 plug contact of the USB 3.0 plug, and then the front end portion enters a long hole 121*a* (to be described) of the second block 120 together with the contact portion 212. The connection portion 214 extends out of the first block 110 of the body 100, and it is connectable to one of the signal lines 11*a* formed on the circuit board 10, as shown in FIG. 2.

The TX− signal contact 220, as shown in FIGS. 2 and 3C, is almost identical to the TX+ signal contact 210, except that its connection portion 224 is to be connected to the other signal line 11*a* on the circuit board 10. A body portion 221, a contact portion 222, and a bent portion 223 of the TX− signal contact 220 are shown in FIG. 4. Accordingly, further descriptions of the TX− signal contact 220 are not given.

The RX+ signal contact 240, as shown in FIGS. 2 and 3C, is almost identical to the TX+ signal contact 210, except that its connection portion 244 is to be connected to one of the signal lines 13*a* on the circuit board 10. The RX− signal contact 250 is also almost identical to the TX+ signal contact 210, except that its connection portion 254 is to be connected to the other signal line 13*a* on the circuit board 10. A body portion 241, a contact portion 242, and a bent portion 243 of the RX+ signal contact 240 and a body portion 251, a contact portion 252, and a bent portion 253 of the RX− signal contact 250 are shown in FIG. 4. Accordingly, further descriptions of the RX+ signal contact 240 and the RX− signal contact 250 are not given.

The ground contact 230, as shown in FIGS. 2 and 3C, is almost identical to the TX+ signal contact 210, except that its connection portion 234 is to be connected to the ground line 12*b* on the circuit board 10. A body portion 231, a contact portion 232, and a bent portion 233 of the ground contact 230 are shown in FIG. 4. Accordingly, further descriptions of the ground contact 230 are not given.

The USB 2.0 contact group 300 as shown in FIGS. 1 to 4 includes a Vbus contact 310 (a second contact), a Data-contact 320 (one of a pair of second differential signal contacts), a Data+ contact 330 (the other of the pair of second differential signal contacts), and a GND contact 340 (a second contact).

The Vbus contact 310, as shown in FIGS. 3D and 4, has a plate-like body portion 311, a plate-like contact portion 312 continuing to a front end of the body portion 311, a bent portion 313 continuing to a rear end of the body portion 311, and a cuboid connection portion 314 continuing to a rear end of the bent portion 313.

The front end portion of the body portion 311 is buried by insert molding in a base portion 121 (to be described) of the second block 120 of the body 100. The rear end portion of the body portion 311 is projected backward from a rear end surface of the base portion 121. The contact portion 312 inserted into a guide hole 121*b* (to be described) of the base portion 121 is exposed from an upper surface of the base portion 121. The upper surface of the contact portion 312 is adapted to contact a USB 2.0 plug contact of a USB 2.0 plug. When pressed by a USB 2.0 plug contact, the contact portion 312 is elastically deformed downward inside the guide hole 121*b*. The bent portion 313 is bent downward in such a manner that a lower surface of the connection portion 314 is brought to the same height as a lower surface of the connection portion 214 of the TX+ signal contact 210. The connection portion 314 extending outside the second block 120 is to be connected to the power source line lib on the circuit board 10.

The GND contact 340, as shown in FIGS. 2, 3D, and 4, is almost identical to the Vbus contact 310, except that its connection portion 344 is to be connected to the ground line 13*b* on the circuit board 10. A body portion 341, a contact portion 342, and a bent portion 343 of the GND contact 340 are shown in FIG. 4. Accordingly, further descriptions of the GND contact 340 are not given.

The Data− contact 320, as shown in FIGS. 2, 3D and 4, is almost identical to the Vbus contact 310, except that its contact portion 322 is shorter in length than the contact portion 312, and that its connection portion 324 is to be connected to one of the signal lines 12*a* on the circuit board 10. A body portion 321 and a bent portion 323 of the Data− contact 320 are shown in FIG. 4. Accordingly, further descriptions of the Data− contact 320 are not given.

The Data+ contact 330, as shown in FIGS. 2, 3D and 4, is almost identical to the Data− contact 320, except that its connection portion 334 is to be connected to the other signal line 12*a* on the circuit board 10. A body portion 331, a contact portion 332, and a bent portion 333 of the Data+ contact 330 are shown in FIG. 4. Accordingly, further description of the Data+ contact 330 are not given.

As shown in FIGS. 1 to 4, the body 100 has the first block 110 and the second block 120, both made of insulating resin. The first block 110 is generally T-shaped in plan view, while the second block 120 is generally L-shaped in section view.

The second block 120 has the said base portion 121, a pair of guide plates 122 (guide members), and a contact guide 123. The guide plates 122 are disposed on the rear end portions at opposite widthwise ends of the base portion 121. The contact guide 123 is provided on the rear end portion of the base portion 121 and between front end portions of the guide plates 122.

In the rear end portion of the base portion 121, there are buried front end portions of the body portions 311, 321, 331, 341 of the Vbus contact 310, the Data− contact 320, the Data− contact 320, and the GND contact 340 of the USB 2.0 contact group 300. These front end portions are spaced apart from one another in the width direction of the second block 120.

The front end portion of the base portion 121 has four guide holes 121*b* formed vertically therethrough, as shown in FIGS. 2, 3A and 3C. The guide holes 121*b* receive the contact portions 312, 322, 332, 342 of the Vbus contact 310, the Data− contact 320, the Data+ contact 330 and the GND contact 340 of the USB 2.0 contact group 300. The contact portions 312, 322, 332, 342 are exposed from the upper surface of the base portion 121, particularly from the guide holes 121*b*.

As shown in FIGS. 3C and 4, the base portion 121 further has the said five long holes 121*a* communicating with the guide grooves 123*a* and arranged between the body portions 311, 321, 331, 341 of the Vbus contact 310, the Data− contact 320, the Data+ contact 330 and the GND contact 340. In other words, the long holes 121*a* and the body portions 311, 321, 331, 341 are alternately arranged.

The guide plates 122 are each provided, along the rear end portion of the inner surface thereof, with a guide recess 122*a* for receiving a guide projection 111 (to be described) of the first block 110. That is, the guide recesses 122*a* are used to guide the guide projections 111, thereby holding the first block 110 between the rear end portions of the paired guide plates 122 of the second block 120.

The contact guide 123 have the said five guide grooves 123*a*, which are arranged at the same spacing as the long holes 121*a*. Each guide groove 123*a* excluding the central one has a beam portion 123*b* suspended between its edges.

A width dimension of the first block 110 is slightly smaller than a distance between the pair of guide plates 122 of the second block 120. That is, the first block 110 can be inserted between the pair of guide plates 122 of the second block 120. Moreover, the guide projections 111 extend along widthwise end surfaces of the first block 110 as shown in FIG. 4. These guide projections 111 are inserted into the respective guide recesses 122*a* of the guide plates 122. A pair of flanges 112 projects outward from the opposite widthwise ends at the rear end of the first block 110. The flanges 112 are to abut on rear ends of the guide plates 122 of the second block 120.

As shown in FIG. 4, an inclined recess 113 is formed in a central portion of the upper surface of the first block 110. The inclined recess 113 is used to lock a locking piece 411 of the shell 400 so as to prevent the first block 110 from falling off backward.

Moreover, the first block 110 have the TX+ signal contact 210, the TX− signal contact 220, the ground contact 230, and the RX+ signal contact 240 and the RX− signal contact 250 of the USB 3.0 contact group 200 buried therein, in a spaced relationship from one another in the width direction of the first block 110.

When the first block 110 is held by the guide plates 122 of the second block 120, the front end portions of the body portions 211, 221, 231, 241, 251 of the TX+ signal contact 210, the TX− signal contact 220, the ground contact 230, the RX+ signal contact 240, and the RX− signal contact 250 enter the respective guide grooves 123*a*. At the same time, the front end portions of the body portions 211, 221, 231, 241, 251, and the contact portions 212, 222, 232, 242, 252 are brought over the long holes 121*a* of the base portion 121 of the second block 120. As a result, the USB 3.0 contact group 200 and the USB 2.0 contact group 300 extend in the same direction but substantially in parallel at different height positions with each other.

Figure 5:
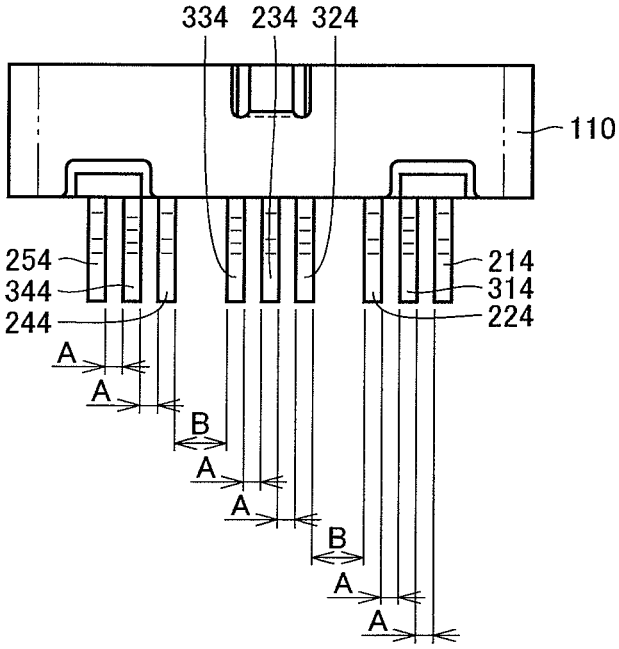
FIG. 5 is a schematic plan view of the connector, showing distances between connection portions of contacts of first and second contact groups.

More specifically, as shown in FIGS. 3A to 3D, the Vbus contact 310 is located so as to face a space between the TX+ signal contact 210 and the TX− signal contact 220. The GND contact 340 is located so as to face a space between the RX+ signal contact 240 and the RX− signal contact 250. The ground contact 230 is located so as to face a space between the Data− contact 320 and the Data+ contact 330. In other words, in plane position, the Vbus contact 310 is located between the TX+ signal contact 210 and the TX− signal contact 220, the GND contact 340 between the RX+ signal contact 240 and the RX− signal contact 250, and the ground contact 230 between the Data− contact 320 and the Data+ contact 330. In such arrangement of the contacts of the USB 3.0 contact group 200 and the USB 2.0 contact group 300, their connection portions are lined up in the order of 214, 314, 224, 324, 234, 334, 244, 344, 254, as shown in FIG. 5. It should be noted here that a distance B between the connection portion 224 and the connection portion 324 or between the connection portion 334 and the connection portion 244 is larger than a distance A between the connection portion 214 and the connection portion 314, between the connection portion 224 and the connection portion 314 or the like.

Figure 6:
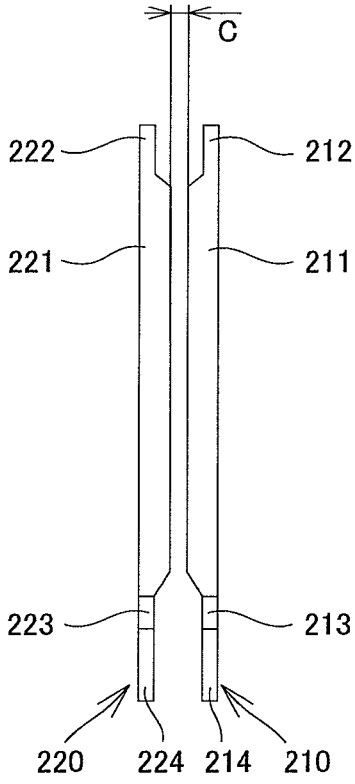
FIG. 6 is a schematic view showing an example to match impedances between a TX+ signal contact and a TX− signal contact of the connector.
Figure 7:
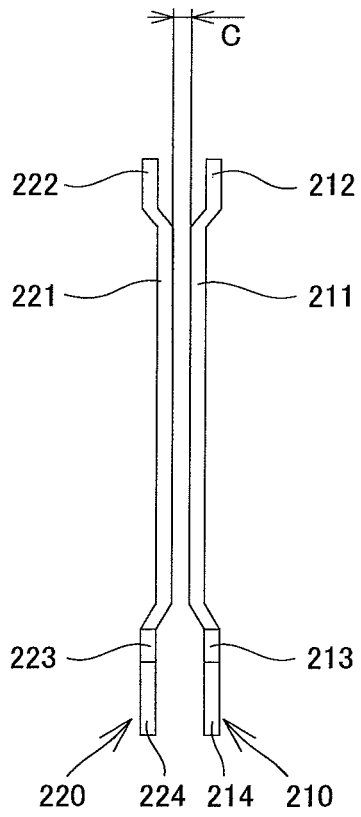
FIG. 7 is a schematic view showing another example to match impedances between the TX+ signal contact and the TX− signal contact of the connector.

Moreover, in the above described arrangement where the connection portions of the USB 3.0 contact group 200 and the USB 2.0 contact group 300 are lined up at the same height in the order of 214, 314, 224, 324, 234, 334, 244, 344, 254, the distance A between the connection portion 224 and the connection portion 314 or the like should be smaller than a distance C between the body portion 211 and the body portion 221 or the like, which should result in impedance mismatching between the TX+ signal contact 210 and the TX− signal contact 220 or the like. To avoid such mismatching, the distance C between the body portion 211 and the body portion 221 is adjusted in accordance with the impedance difference between the TX+ signal contact 210 and the TX− signal contact 220. In the present embodiment, as shown in FIG. 6, the body portion 211 of the TX+ signal contact 210 and the body portion 221 of the TX− signal contact 220 are extended inward in the width dimension to reduce the distance C. Alternatively, as shown in FIG. 7, the body portion 211 of the TX+ signal contact 210 and the body portion 221 of the TX− signal contact 220 may be bent in a direction close to each other (i.e. inward) to reduce the distance C, whereby the distance A and the distance C are set to be almost the same. In either case, the TX+ signal contact 210 and the TX− signal contact 220 can be matched in impedance. Particularly, the former case can obviate the necessity for bending the TX+ signal contact 210 and the TX− signal contact 220 inward when arranging the connection portion 314 between the connection portions 214 and 224. Consequently, the TX+ signal contact 210 and the TX− signal contact 220 can be improved in high-frequency characteristics. Another advantage in simply adjusting the distance C between the body portion 211 and the body portion 221 is that the connector has a simplified structure with matched impedance between the TX+ signal contact 210 and the TX− signal contact 220. It should be noted that a similar distance adjustment is made between the body portion 241 of the RX+ signal contact 240 and the body portion 251 of the RX− signal contact 250. No further description on this adjustment should be unnecessary here.

The shell 400 has a metal shell body 410 of a square-cylindrical shape and a pair of leg portions 420 extended downward from the shell body 410. The shell body 410 surrounds the assembled first and second blocks 110 and 120. A space between the shell body 410 and a front end portion of the base portion 121 of the second block 120 forms a plug insertion hole a for receiving a USB 3.0 plug or a USB 2.0 plug. As shown in FIG. 4, the rear end portion of the upper surface of the shell 410 has the locking piece 411 cut out and bent downward. The locking piece 411 is locked by the inclined recess 113 of the first block 110 to prevent the first block 110 from coming off backward. Moreover, a lower portion of the rear end portion of the shell body 410 is cut out. The leg portions 420 are continuously provided in the rear end portion of the shell body 410. The leg portions 420 are to be inserted into locking holes (not shown) of the circuit board 10 and locked against edges of the locking holes.

The receptacle connector configured as described above is assembled in the following manner. First, the TX+ signal contact 210, the TX− signal contact 220, the ground contact 230, the RX+ signal contact 240, and the RX− signal contact 250, which are buried in the first block 110, are inserted into the guide grooves 123*a* of the second block 120 at their contact portions 212, 222, 232, 242, 252, while the guide projections 111 of the first block 110 are inserted into the guide recesses 122*a* of the paired guide plates 122 of the second block 120. As a result, the front end portions of the body portions 211, 221, 231, 241, 251 of the TX+ signal contact 210, the TX− signal contact 220, the ground contact 230, the RX+ signal contact 240 and the RX− signal contact 250 are received in the respective guide grooves 123*a*, and then the front end portions of the body portions 211, 221, 231, 241, 251 and the contact portions 212, 222, 232, 242, 252 are placed over the long holes 121*a* of the base portion 121 of the second block 120. The first and second blocks 110, 120 are thus assembled and then inserted into the shell body 410. This allows the locking piece 411 of the shell body 410 to be fitted in the inclined recess 113 of the second block 120.

The receptacle connector assembled as described above is mounted on the circuit board 10 in the following steps. First, the leg portions 420 of the shell 400 are inserted into the locking holes of the circuit board 10. Upon the insertion, the connection portion 214 is placed on the one signal line 11*a* on the circuit board 10; the connection portion 314 is placed on the power source line 11*b* on the circuit board 10; the connection portion 224 is placed on the other signal line 11*a* on the circuit board 10; the connection portion 324 is placed on the one signal line 12*a* on the circuit board 10; the connection portion 234 is placed on the ground line 12*b* on the circuit board 10; the connection portion 334 is placed on the other signal line 12*a* on the circuit board 10; the connection portion 244 is placed on the one signal line 13*a* on the circuit board 10; the connection portion 344 is placed on the ground line 13*b* on the circuit board 10; and the connection portion 254 is placed on the other signal line 13*a* on the circuit board 10.

In this state, the connection portion 214 is connected to the one signal line 11*a* on the circuit board 10 by soldering. The connection portion 314 is connected to the power source line 11*b* on the circuit board 10 by soldering. The connection portion 224 is connected to the other signal line 11*a* on the circuit board 10 by soldering. The connection portion 324 is connected to the one signal line 12*a* on the circuit board 10 by soldering. The connection portion 234 is connected to the ground line 12*b* on the circuit board 10 by soldering. The connection portion 334 is connected to the other signal line 12*a* on the circuit board 10 by soldering. The connection portion 244 is connected to the one signal line 13*a* on the circuit board 10 by soldering. The connection portion 344 is connected to the ground line 13*b* on the circuit board 10 by soldering. The connection portion 254 is connected to the other signal line 13*a* on the circuit board 10 by soldering.

The receptacle connector is thus mounted on the circuit board 10 and then is ready for connection with a USB 3.0 plug or a USB 2.0 plug.

When a USB 3.0 plug is inserted into the plug insertion hole α of the connector, USB 3.0 plug contacts of the USB 3.0 plug come into contact with respective tops of the contact portions 212, 222, 232, 242, 252 of the TX+ signal contact 210, the TX− signal contact 220, the ground contact 230, the RX+ signal contact 240, and the RX− signal contact 250. At this time, the USB 3.0 plug contacts press the contact portions 212, 222, 232, 242, 252, so that the front end portions of the body portions 211, 221, 231, 241, 251 are elastically deformed downward. Consequently, the front end portions of the body portions 211, 221, 231, 241, 251 and the contact portions 212, 222, 232, 242, 252 enter the respective long holes 121*a* of the second block 120.

When a USB 2.0 plug is inserted into the plug insertion hole α of the connector, USB 2.0 plug contacts of the USB 2.0 plug come into contact with upper surfaces of the contact portions 312, 322, 332, 342 of the Vbus contact 310, the Data− contact 320, the Data− contact 320, and the GND contact 340, respectively. At this time, the USB 2.0 plug contacts of USB 2.0 plug press the contact portions 312, 322, 332, 342, so that the contact portions 312, 322, 332, 342 are elastically deformed downward inside the guide holes 121*b* of the second block 120.

In the above-described receptacle connector, the distance B between the connection portion 224 and the connection portion 324 or between the connection portion 334 and the connection portion 244 is larger than the distance A between the connection portion 214 and the connection portion 314 or the like. This arrangement can reduce the occurrence of crosstalks between differential contact pairs at their connection portions. More particularly, the occurrence of crosstalks is reduced between the connection portions 214, 224 of the TX+ and TX− signal contacts 210, 220 and the connection portions 324, 334 of the Data− and Data+ contacts 320, 330. The occurrence of crosstalks is similarly reduced between the connection portions 324, 334 of the Data− and Data+ contacts 320, 330 and the connection portions 244, 254 of the RX+ and RX− signal contacts 240, 250.

Further, the connection portion 314 of the Vbus contact 310 is located between the connection portion 214 of the TX+ signal contact 210 and the connection portion 224 of the TX− signal contact 220. This location is advantageous in minimizing the length of the power source line 11*b* on the signal plane of the circuit board 10, by connecting the power source line 11*b* for connection with the connection portion 314 on the circuit board 10 to the intermediate layer (that differs from the signal plane) of the circuit board 10. Consequently, the signal lines 11*a* on the circuit board 10 for connection with the connection portions 214, 224 can be formed almost straight, thus facilitating the connection by soldering of the connection portions 214, 224 to the signal lines 11*a* on the circuit board 10. Similarly, the connection portion 234 of the ground contact 230 is located between the connection portion 324 of the Data− contact 320 and the connection portion 334 of the Data+ contact 330. This location is advantageous in minimizing the length of the ground line 12*b* on the signal plane of the circuit board 10, by connecting the ground line 12*b* to the ground plane of the circuit board 10. Consequently, the signal lines 12*a* on the circuit board 10 for connection with the connection portions 324, 334 can be formed almost straight, thus facilitating the connection by soldering of the connection portions 324, 334 to the signal lines 12*a* on the circuit board 10. Moreover, the connection portion 344 of the GND contact 340 is located between the connection portion 244 of the RX+ signal contact 240 and the connection portion 254 of the RX− signal contact 250. This location is advantageous in minimizing the length of the ground line 13*b* on the signal plane of the circuit board 10, by connecting the ground line 13*b* for connection with the connection portion 344 on the circuit board 10 to the ground plane of the circuit board 10. Consequently, the signal lines 13*a* on the circuit board 10 for connection with the connection portions 244, 254 can be formed almost straight, thus facilitating the connection by soldering of the connection portions 244, 254 to the signal lines 13*a* on the circuit board 10. Moreover, the almost straight signal lines 11*a*, 12*a*, 13*a* of the circuit board 10, having no bent portions, can deter reflection of signals causing deterioration in transmission characteristics.

Furthermore, the Vbus contact 310 of the USB 2.0 contact group 300 is located so as to face the space between the TX+ signal contact 210 and the TX− signal contact 220 that make a differential pair in the USB 3.0 contact group 200. Although the Vbus contact 310 is not a reference ground of the TX+ signal contact 210 and the TX− signal contact 220 making the differential pair, it serves as a ground for the TX+ signal contact 210 and the TX− signal contact 220 in terms of high frequency. Consequently, the Vbus contact 310 can be used for impedance matching between the TX+ signal contact 210 and the TX− signal contact 220, thus improving transmission characteristics of the TX+ signal contact 210 and the TX− signal contact 220. Similarly, the GND contact 340 of the USB 2.0 contact group 300 is located so as to face the space between the RX+ signal contact 240 and the RX− signal contact 250 that make another differential pair in the USB 3.0 contact group 200. Although the GND contact 340 is not a reference ground of the RX+ signal contact 240 and the RX− signal contact 250, it serves as a ground for the RX+ signal contact 240 and the RX− signal contact 250 in terms of high frequency. Consequently, the GND contact 340 can be used for impedance matching between the RX+ signal contact 240 and the RX− signal contact 250, thus improving transmission characteristics of the RX+ signal contact 240 and the RX− signal contact 250. Moreover, the ground contact 230 of the USB 3.0 contact group 200 is located so as to face the space between the Data− contact 320 and the Data+ contact 330 of the USB 3.0 contact group 200. Although the ground contact 230 is not a reference ground of the Data− contact 320 and the Data+ contact 330, it serves as a ground for the Data− contact 320 and the Data− contact 320 in terms of high frequency. Consequently, the ground contact 230 can be used for impedance matching between the Data− contact 320 and the Data+ contact 330, thus improving transmission characteristics of the Data− contact 320 and the Data+ contact 330.

In short, the Vbus contact 310 of the USB 2.0 contact group 300 is used for impedance matching between differential pair contacts of the USB 3.0 contact group 200, namely the TX+ signal contact 210 and the TX− signal contact 220. The GND contact 340 of the USB 2.0 contact group 300 is used for impedance matching between the other differential pair contacts of the USB 3.0 contact group 200, namely the RX+ signal contact 240 and the RX− signal contact 250. The ground contact 230 of the USB 3.0 contact group 200 is used for impedance matching between the differential pair contacts of the USB 2.0 contact group 300, namely the Data− contact 320 and the Data+ contact 330. Consequently, the connector has a simple configuration, compared to a case of adding contacts for impedance matching between differential pair contacts. In this respect, the present receptacle connector is advantageous in downsizing and cost reduction.

The foregoing connector is not limited to the above-described embodiment, but can be modified in design can be in any manner within the scope of the claims. Modifications will be hereinafter described in detail.

The body 100 according to the above embodiment has the first and second blocks 110, 120. However, the body 100 may be made of a single block. Obviously, the body 100 can be divided into three or more blocks.

In the above-described embodiment, the guide projections 111 are provided on the opposite widthwise end surfaces of the first block 110, and the guide recesses 122*a* are provided in the inner surfaces of the guide plates 122 of the second block 120. However, the first and second blocks 110, 120 can be assembled using any other attachment means. For example, the first block 110 may have a locking piece or a locking hole to be locked by a locking hole or a locking piece, respectively, of the second block 120. It is also obviously possible to provide the guide projections 111 on the inner surfaces of the guide plates 122 and the guide recesses 122*a* in the opposite end surfaces of the first block 110.

The contacts of the USB 3.0 contact group 200 and the USB 2.0 contact group 300 may be or may not be buried in the first and second blocks 110, 120, respectively. For example, the body may have attachment holes for receiving the contacts of the USB 3.0 contact group 200 and the USB 2.0 contact group 300.

The connector according to the above-described embodiment includes the USB 3.0 contact group 200 and the USB 2.0 contact group 300. However, the connector only need to include first and second contact groups of any kind that are arrayed substantially in parallel and at different heights inside the body. Along the same lines, the first contact group can be arranged pursuant to a certain first standard, and the second contact group can be arranged pursuant to a second standard that is different from the first standard. The minimum requirements are that the first contact group has at least a pair of first signal contacts and a first contact, and that the second contact group has at least a pair of second signal contacts and a second contact.

Alternatively, the first signal contacts of the first contact group may be for differential signaling, while the second signal contacts of the second contact group may be for single-ended signaling. Similarly, the second signal contacts of the second contact group may be for differential signaling, while the first signal contacts of the first contact group may be for single-ended signaling.

Furthermore, the present invention is not limited to the case of the embodiment where the distance C between the body portion 211 and the body portion 221 is adjusted in accordance with the impedance difference between the TX+ signal contact 210 and the TX− signal contact 220, and where the distance between the body portion 241 and the body portion 251 is adjusted in accordance with the impedance difference between the RX+ signal contact 240 and the RX− signal contact 250. Moreover, each distance between the body portions only need to be adjusted in accordance with the impedance difference between the differential signal contacts, and each distance between the portions other than the body portions (the foregoing contact portions and/or bent portions) may be adjusted in accordance with the impedance difference between the differential signal contacts. However, such impedance matching does not need to be conducted when unnecessary. Similarly to the body portions 211 and 221, a distance between the body portions 321 and 331 of the USB 2.0 contact group 300 can also be adjusted in accordance with impedance difference between Data− contact 320 and the Data+ contact 330.

Lastly, the present invention is not limited to a receptacle connector mountable on a circuit board 10. For example, the connector may be a plug connector having contacts whose connection portions are connectable to a cable or the like.

Reference Signs List

100 body
110 first block
120 second block
122 guide plate (guide member)
200 USB 3.0 contact group (first contact group)
210 TX+ signal contact (first signal contact)
211 body portion
212 contact portion
213 bent portion
214 connection portion
220 TX− signal contact (first signal contact)
221 body portion
222 contact portion
223 bent portion
224 connection portion
230 ground contact (first contact)
231 body portion
232 contact portion
233 bent portion
234 connection portion
240 RX+ signal contact (first signal contact)
241 body portion
242 contact portion
243 bent portion
244 connection portion
250 RX− signal contact (first signal contact)
251 body portion
252 contact portion
253 bent portion
254 connection portion
300 USB 2.0 contact group (second contact group)
310 Vbus contact (second contact)
314 connection portion
320 Data− contact (second signal contact)
324 connection portion
330 Data+ contact (second signal contact)
334 connection portion
340 GND contact 340 (second contact)
344 connection portion
400 shell

The invention claimed is:

1. A connector comprising:

a body with insulation properties;

a first contacts group including a pair of first signal contacts and a first ground or power source contact; and a second contacts group including a pair of second signal contacts and a second ground or power source contact, wherein the pair of first signal contacts is disposed next to each other at a first height position inside the body, the first signal contacts each including a connection portion disposed at a second height position outside the body, the pair of second signal contacts is disposed next to each other at a third height position that is different from the first height position inside the body, the second signal contacts each including a connection portion disposed at the second height position outside the body, the connection portion of one of the second signal contacts and the connection portion of one of the first signal contacts are located next to each other, the first ground or power source contact is disposed next to the one of the first signal contacts at the first height position inside the body so as to be located between the second signal contacts in plane position, the first ground or power source contact including a connection portion disposed between the connection portions of the second signal contacts at the second height position, the second ground or power source contact is disposed next to the one of the second signal contacts at the third height position inside the body so as to be located between the first signal contacts in plane position, the second ground or power source contact including a connection portion disposed between the connection portions of the first signal contacts at the second height position, all the connection portions are arrayed in a row, and a distance B is larger than a distance A, wherein the distance A is a distance between the connection portion of each of the first signal contacts and the connection portion of the second ground or power source contact and also a distance between the connection portion of each of the second signal contacts and the connection portion of the first ground or power source contact, and the distance B is a distance between the connection portion of the one of the first signal contacts and the connection portion of the one of the second signal contacts.

2. The connector according to claim 1, wherein the first and second signal contacts are contacts for differential signaling.

3. The connector according to claim 2, wherein the first contacts group is arranged in compliance with a first standard, and the second contacts group is arranged in compliance with a second standard that is different from the first standard.

4. The connector according to claim 2, wherein the first contacts group further includes an additional pair of the first signal contacts, and the second ground or power source contact comprises a second ground contact and a second power source contact, the second ground contact is disposed next to the one of the second signal contacts at the third height position inside the body so as to be located in plane position between the first signal contacts of one of the pairs, the second ground contact including a connection portion disposed at the second height position between the connection portions of the first signal contacts of the one of the pairs, the second power source contact is disposed next to the other of the second signal contacts at the third height position inside the body so as to be located in plane position between the first signal contacts of the other of the pairs, the second power source contact including a connection portion disposed at the second height position between the connection portions of the first signal contacts of the other of the pairs.

5. The connector according to claim 4, wherein the first contacts group is a USB 3.0 compliant contacts group, and the second contacts group is a USB 2.0 compliant contacts group.

6. The connector according to claim 4, wherein the first contacts group is arranged in compliance with a first standard, and the second contacts group is arranged in compliance with a second standard that is different from the first standard.

7. The connector according to claim 1, wherein the first contacts group is arranged in compliance with a first standard, and the second contacts group is arranged in compliance with a second standard that is different from the first standard.

8. The connector according to claim 1, wherein the first signal contacts each further include a contact portion contactable with a contact of a counterpart connector and a body portion continuing to the contact portion, and a distance C is substantially the same as the distance A, where the distance C is a distance between the body portions of the first signal contacts.

9. The connector according to claim 1, wherein the first signal contacts each further include a contact portion contactable with a contact of a counterpart connector and a body portion continuing to the contact portion, and the body portions of the first signal contacts are extended in width dimension such that a distance C is substantially the same as the distance A, where the distance C is a distance between the body portions of the first signal contacts.

10. The connector according to claim 1, wherein the first signal contacts each further include a contact portion contactable with a contact of a counterpart connector and a body portion continuing to the contact portion, and the body portions of the first signal contacts are bent closer to each other such that a distance C is substantially the same as the distance A, where the distance C is a distance between the body portions of the first signal contacts.

11. The connector according to claim 1, wherein the body has a first block, in which the first contacts group is disposed, and a second block, in which the second contacts group is disposed, and when the first block is attached to the second block, the first ground or power source contact is placed so as to face the space between the pair of second signal contacts, and the second ground or power source contact is placed so as to face the space between the pair of the first signal contacts to face the first signal contacts.

12. The connector according to claim 11, wherein the second block has a base portion, in which the second contacts group is disposed, and a pair of guide members provided on the base portion to hold opposite end portions of the first block in a slidable manner.

13. A connector comprising:

a body with insulation properties;

a first contacts group including a pair of first signal contacts and a first ground or power source contact; and a second contacts group including a pair of second signal contacts and a second ground or power source contact, wherein (a) the first signal contacts each include:

a body portion held in the body, the body portions of the first signal contacts being disposed next to each other at a first height position, a contact portion continuing to a front end of the body portion, the contact portions of the first signal contacts being disposed next to each other, a bent portion continuing to a rear end of the body portion, and a connection portion continuing to a rear end of the bent portion, the connection portions of the first signal contacts being disposed at a second height position outside the body, (b) the second signal contacts each include:

a body portion held in the body, the body portions of the second signal contacts being disposed next to each other at a third height position that is different from the first height position, a contact portion continuing to a front end of the body portion of each of the second signal contacts, the contact portions of the second signal contacts being disposed next to each other, a bent portion continuing to a rear end of the body portion of each of the second signal contacts, and a connection portion continuing to a rear end of the bent portion of each of the second signal contacts, the connection portions of the second signal contacts being disposed at the second height position outside the body, (c) the connection portion of one of the second signal contacts and the connection portion of one of the first signal contacts are located next to each other, (d) the first ground or power source contact includes:

a body portion held in the body and disposed next to the body portion of the one of the first signal contacts at the first height position and between the body portions of the second signal contacts in plane position, a contact portion continuing to a front end of the body portion of the first ground or power source contact and disposed next to the contact portion of the one of the first signal contacts and between the contact portions of the second signal contacts in plane position, a bent portion continuing to a rear end of the body portion of the first ground or power source contact, and a connection portion continuing to a rear end of the bent portion of the first ground or power source contact and disposed between the connection portions of the second signal contacts at the second height position outside the body, the second ground or power source contact includes:

a body portion held in the body and disposed next to the body portion of the one of the second signal contacts at the third height position and between the body portions of the first signal contacts in plane position, a contact portion continuing to a front end of the body portion of the second ground or power source contact and disposed next to the contact portion of the one of the second signal contacts and between the contact portions of the first signal contacts in plane position, a bent portion continuing to a rear end of the body portion of the second ground or power source contact, and a connection portion continuing to a rear end of the bent portion of the second ground or power source contact and disposed between the connection portions of the first signal contacts at the second height position outside the body, and (e) a distance B is larger than a distance A, and a distance C is substantially the same as the distance A, wherein the distance A is a distance between the connection portion of each of the first signal contacts and the connection portion of the second ground or power source contact and also a distance between the connection portion of each of the second signal contacts and the connection portion of the first ground or power source contact, the distance B is a distance between the connection portion of the one of the first signal contacts and the connection portion of the one of the second signal contacts, and the distance C is a distance between the body portions of the first signal contacts.

* * * * *